US011103020B2

(12) United States Patent
Fukuda et al.

(10) Patent No.: US 11,103,020 B2
(45) Date of Patent: Aug. 31, 2021

(54) SPORTS UPPER CLOTHING

(71) Applicant: ASICS CORPORATION, Kobe (JP)

(72) Inventors: Makoto Fukuda, Kobe (JP); Kenichi Kitazume, Kobe (JP); Tatsuya Ishikawa, Kobe (JP); Mamoru Omuro, Kobe (JP); Yutaka Koga, Kobe (JP)

(73) Assignee: ASICS CORPORATION

( * ) Notice: Subject to any disclaimer, the term of this patent is extended or adjusted under 35 U.S.C. 154(b) by 178 days.

(21) Appl. No.: 15/712,822

(22) Filed: Sep. 22, 2017

(65) Prior Publication Data

US 2018/0007985 A1 Jan. 11, 2018

Related U.S. Application Data

(63) Continuation-in-part of application No. PCT/JP2015/058940, filed on Mar. 24, 2015.

(51) Int. Cl.

| | |
|---|---|
| ***A41D 27/28*** | (2006.01) |
| ***A41D 27/10*** | (2006.01) |
| ***A41D 1/04*** | (2006.01) |
| ***A41D 31/102*** | (2019.01) |
| ***A41D 13/00*** | (2006.01) |

(52) U.S. Cl.

CPC ..... *A41D 27/28* (2013.01); *A41D 13/0015* (2013.01); *A41D 27/10* (2013.01); *A41D 31/102* (2019.02); *A41D 1/04* (2013.01); *A41D 2600/10* (2013.01)

(58) Field of Classification Search

CPC .... A41B 1/00; A41B 1/02; A41B 1/08; A41B 1/18; A41B 2400/20; A41D 27/28; A41D 31/102; A41D 27/10; A41D 1/04; A41D 13/0015; A41D 13/14; A41D 2600/104; A41D 31/14; A62B 17/005; Y10S 2/01

USPC ..... 2/115, 77, 106, 122, DIG. 1

See application file for complete search history.

(56) References Cited

U.S. PATENT DOCUMENTS 1,799,572 A * 4/1931 Sweeney ..... A41B 1/00 2/115
2,079,980 A * 5/1937 Anders ..... A41D 27/28 2/105

(Continued)

FOREIGN PATENT DOCUMENTS

DE 102004007811 A1 * 4/2005 ..... A41D 27/28
EP 1 518 472 A1 3/2005

(Continued)

OTHER PUBLICATIONS

International search report in English for International Application No. PCT/JP2015/058940 dated Jun. 16, 2015.

(Continued)

*Primary Examiner* — Jameson D Collier
(74) *Attorney, Agent, or Firm* — Katten Muchin Roseman LLP

(57) ABSTRACT

Described is sports upper clothing which as an improved cooling function and which includes a front body, a back body, and sleeves. In embodiments, each sleeve has a front portion located on a same side as the front body and a back portion located on a same side as the back body. The back portion is made of a fabric having a breathability value and the front portion has breathability value that is greater than the breathability value of the back portion.

17 Claims, 19 Drawing Sheets

(56) References Cited

U.S. PATENT DOCUMENTS 3,561,009 A * 2/1971 Huggins ..... A41D 1/04 2/122
3,761,962 A * 10/1973 Myers ..... A41D 27/28 2/227
3,801,987 A * 4/1974 Thompson, Jr. ..... A41D 27/10 2/125
4,722,099 A * 2/1988 Kratz ..... A41D 27/28 2/115
4,813,081 A * 3/1989 Cliff ..... A41D 1/04 2/115
4,996,723 A * 3/1991 Huhn ..... A41D 1/22 2/105
5,105,478 A * 4/1992 Pyc ..... A41D 27/28 2/115
5,347,658 A * 9/1994 Clark ..... A41D 27/08 2/115
5,608,913 A * 3/1997 Lacoste ..... A41D 13/00 2/108
5,704,064 A * 1/1998 van der Sleesen .... A41D 27/28 2/69
5,727,256 A * 3/1998 Rudman ..... A41D 27/28 2/115
5,845,336 A * 12/1998 Golde ..... A41D 27/28 2/93
6,339,845 B1 * 1/2002 Burns ..... A41D 31/14 2/243.1
8,133,824 B2 * 3/2012 Harber ..... A41D 1/04 442/1
8,555,414 B2 * 10/2013 Davis ..... A41D 13/0053 2/115
9,301,556 B2 * 4/2016 Koller ..... A41D 3/02
2005/0066406 A1 * 3/2005 Sleesen ..... A41D 27/28 2/69
2005/0246813 A1 * 11/2005 Davis ..... A41D 13/0053 2/69
2008/0040832 A1 * 2/2008 Bay ..... A41D 27/28 2/93
2010/0242151 A1 * 9/2010 Mather ..... A41D 27/28 2/115
2015/0128326 A1 * 5/2015 Coll ..... A41D 27/08 2/69

FOREIGN PATENT DOCUMENTS

JP H01-089917 U 6/1989
JP H03-103212 U 10/1991
JP 10-273803 A 10/1998
JP H11-247011 A 9/1999
JP 2000-129512 A 5/2000
JP 2000-239906 A 9/2000
JP 3117620 U 12/2005
JP 2007-231464 A 9/2007
JP 2008-223196 A 9/2008
JP 2008-289788 A 12/2008
JP 2011-117121 A 6/2011
JP 5021829 B1 9/2012
JP 2014-226402 A 12/2014
JP 2015-030933 A 2/2015

OTHER PUBLICATIONS

Notification for Refusal for Japanese Patent Application No. 2016-532644 with a date of drafting of Jul. 8, 2016.

* cited by examiner

SPORTS UPPER CLOTHING

CROSS-REFERENCES TO RELATED APPLICATIONS

The present application is a continuation-in-part application of international Application No. PCT/JP2015/058940, filed on Mar. 24, 2015. The content of the application is incorporated herein by reference in their entirety.

BACKGROUND OF INVENTION

The present invention relates to sports upper clothing, and more specifically to sports upper clothing for increased ventilation inside the wear during activities to promote cooling effect, for example, by decreasing temperatures.

BACKGROUND ART

Marathon, tennis and other sports generally tend to increase body temperatures significantly when played for a relatively long period of time. Especially, temperature increase is dramatic when such an activity is performed in a hot and humid environment. Excessive increase in body temperature can decrease performance in the activity.

One solution would be to use highly breathable mesh material for all or major part of the wear to reduce temperature increase during activities. In the following description, the mesh material includes a fabric woven to form meshes and a fabric formed a plurality of vent holes by mechanical punching, laser, etc. There is already known such wear which is partially made of a mesh material for such purposes as increasing a breathability value (see Patent Literature 1 for example).

Patent Literature 1 proposes sports upper clothing in which connecting portions between each sleeve and the front and the back bodies are made of mesh material that has a large number of vent holes and has a superior stretchability to materials of the bodies and each sleeve. In this sports upper clothing, the mesh material improves breathability. However, there is room for improvement from a standpoint of air flow inside the wear since the mesh material is disposed at each connecting portion between the front body and the sleeve, as well as between the back body and the sleeve, allowing air to come in from the mesh material on the front body side, and then flow out through the mesh material on the back body side, without making sufficient air flow inside.

An object of the present invention is to provide sports upper clothing which has increased ventilation inside the wear during activities, for an improved cooling function.

CITATION LIST

Patent Literature

Patent Literature 1: JP-A 2000-129512 Gazette

SUMMARY OF INVENTION

Sports upper clothing according to an aspect of the present invention includes: a front body, a back body and sleeves. The sleeve includes a front portion located on a same side as the front body, and a back portion located on a same side as the back body, the back portion is made of a fabric having a low breathability value and the front portion has a greater breathability value than the back portion, to allow air to enter from, the front portion as a wearer swings his/her arm.

The above arrangement makes it easy for air to enter from the front portion, while making it possible to reduce chances for the air, once it has entered, to flow out of the back portion. As a result, the air which has entered from the sleeve is more likely to flow toward the center of the athlete's body.

According to another aspect, the present invention provides sports upper clothing including: a front body, a back body and sleeves. The sleeve includes a front portion located on a same side as the front body, and a back portion located on a same side as the back body; the front portion has a greater breathability value than the back portion; the front portion is provided with a plurality of vent holes; and the vent holes are formed in an entire region between a sleeve cap line and a sleeve base line of the front portion.

According to another aspect, the present invention provides sports upper clothing including: a front body, a back body and sleeves. The sleeve includes a front portion located on a same side as the front body, and a back portion located on a same side as the back body. The front portion has a greater breathability value than the back portion; and the front portion has a region which is closer to a sleeve base line than to a centerline in up-down direction, has a greater breathability value than a region which is closer to a sleeve cap line than to the centerline.

ADVANTAGEOUS EFFECTS OF INVENTION

In the upper clothing according to the embodiment of the present invention, a back portion of the sleeve is formed of a fabric which has a low breathability value and a front portion of the sleeve has a higher breathability value than the back portion; therefore, when the arm is swung, air enters from the front portion of the sleeve, then hits the back portion which is made of a material having the lower breathability value, and there is an increased air flow toward the center of the athlete's body. By increasing the air flow as described above, it is expected that inside-wear temperatures, for example, will be decreased.

DESCRIPTION OF EMBODIMENTS

Figure 1:
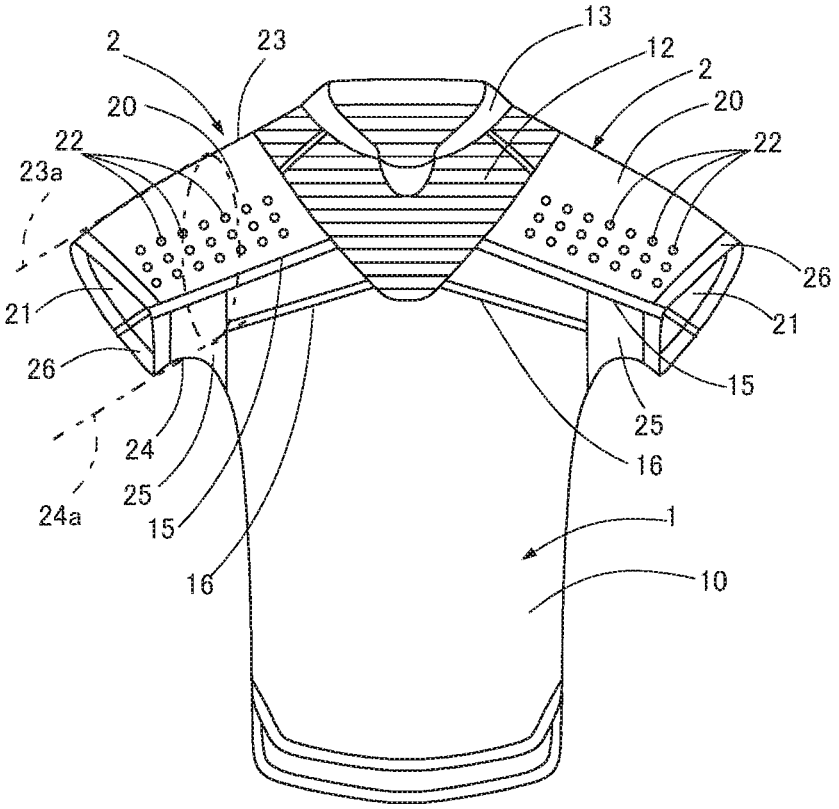
FIG. 1 is a front view of sports upper clothing according to a mode of embodiment of the present invention.

Hereinafter, sports upper clothing according to embodiments of the present invention will be described in detail with reference to the drawings. Upper clothing according to the present embodiment is, for example, tennis wear. FIG. 1 is a front view of the sports upper clothing according to the present embodiment, FIG. 2 is a rear view thereof, and FIG. 3 is a side view thereof.

Figure 2:
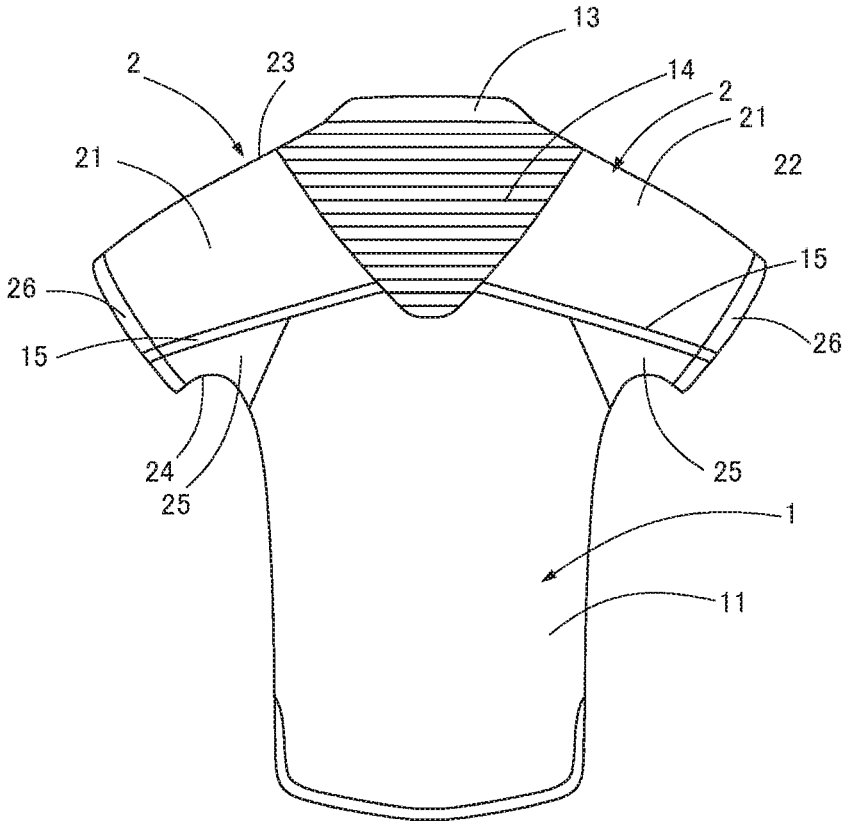
FIG. 2 is a rear view of the sports upper clothing according to the mode of embodiment of the present invention.
Figure 3:
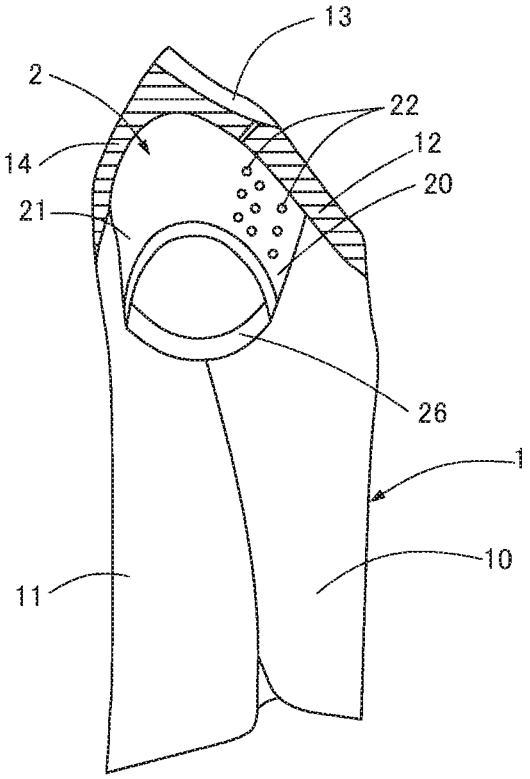
FIG. 3 is a side view of the sports upper clothing according to the mode of embodiment of the present invention.

As shown in FIG. 1 through FIG. 3, this sports upper clothing includes a main body 1 which has a front body 10 and a back body 11; and a pair of sleeves 2 extending as half-sleeves from two sides of an upper portion of the main body 1. The main body 1 has a collar 13 at its top region.

Each sleeve 2 has a front portion 20 located on a same side as the front body 10; and a back portion 21 located on a same side as the back body 11.

While it is common to think that body temperature increase in athletes can be decreased by using a material which has a high breathability value such as mesh material for all parts of the wear, the inventors of the present invention thought differently, and found that there are cases where partially increasing breathability values for increased gradient in breathability within the wear can better decrease temperature rise in the body. Description will now cover how this was demonstrated, with reference to FIG. 9 through FIG. 13.

Figure 9A:
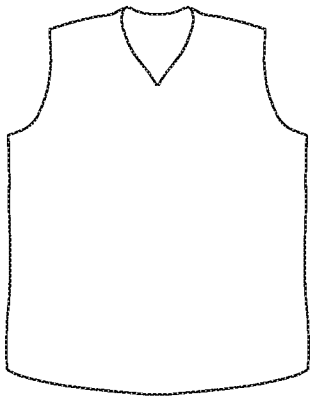
FIG. 9A is a front view of upper clothing for which the cooling effect was demonstrated.
Figure 9B:
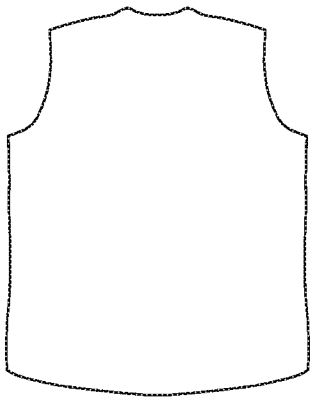
FIG. 9B is a rear view of the upper clothing for which the cooling effect was demonstrated.

FIG. 9 through FIG. 11 show upper clothing which was used in the demonstration: Specifically, it is no-sleeve upper clothing based on basket-ball wear. The wear in FIG. 9A and FIG. 9B has its front face and back face made of fabric with 70% cotton and 30% polyester (hereinafter will be called Normal). FIG. 9A shows the front face and FIG. 9B shows the back face.

Figure 10A:
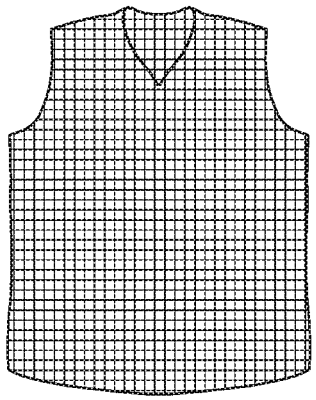
FIG. 10A is a front view of upper clothing for which the cooling effect was demonstrated.
Figure 10B:
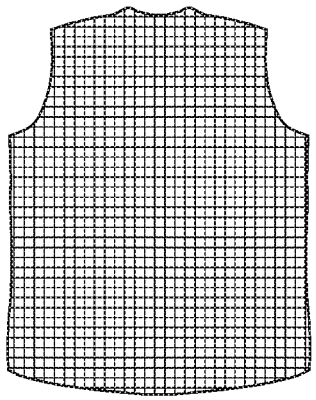
FIG. 10B is a rear view of the upper clothing for which the cooling effect was demonstrated.

The wear in FIG. 10A and FIG. 10B has all of its front face and back face made of mesh material which has a greater breathability value than the fabric used in Normal (hereinafter will be called All Mesh), FIG. 10A shows the front face and FIG. 10B shows the back face.

Figure 11A:
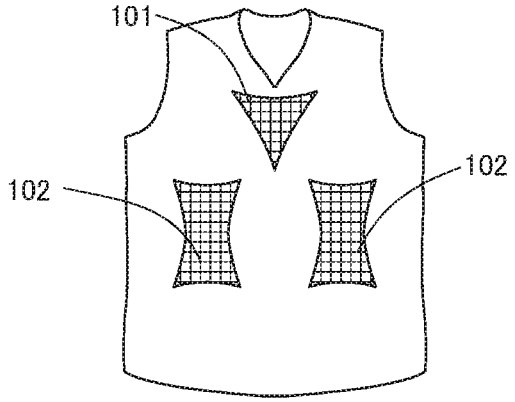
FIG. 11A is a front view of upper clothing for which the cooling effect was demonstrated.
Figure 11B:
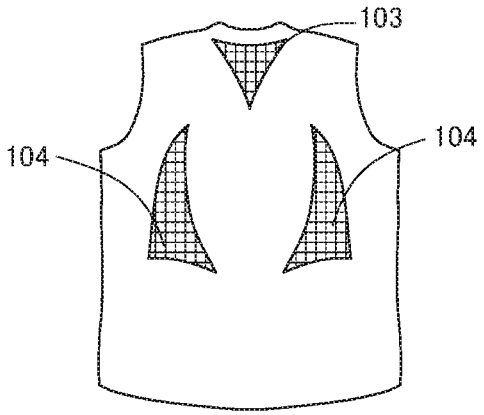
FIG. 11B is a rear view of the upper clothing for which the cooling effect was demonstrated.

The wear in FIG. 11A and FIG. 11B is made of the fabric used in Normal, with partial mesh regions provided by a mesh material (hereinafter called Partial Mesh). As shown in FIG. 11A, the partial mesh portions are provided at a chest region 101 in the front face and two belly regions 102, 102 which are slightly inward from left and right sidelines; and as shown in FIG. 11B, under the neck 103 and two regions 104 under the two scapulae in the back.

Figure 12A:
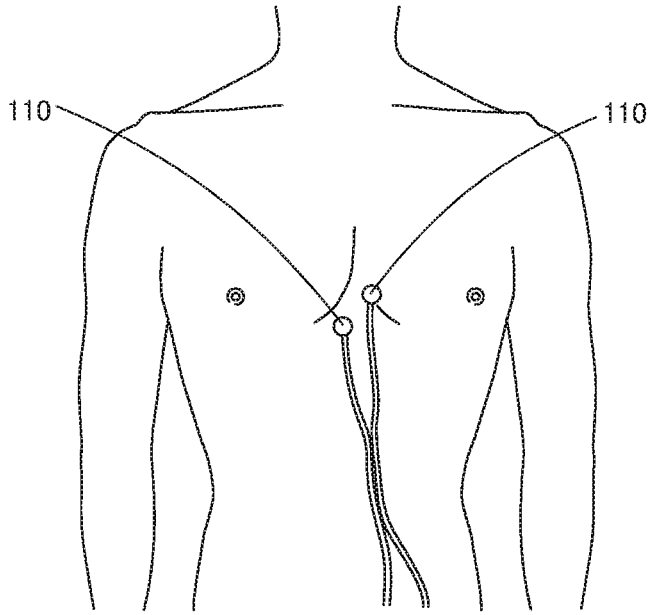
FIG. 12A is an explanatory view showing locations to place digital temperature-humidity sensors to demonstrate cooling
Figure 12B:
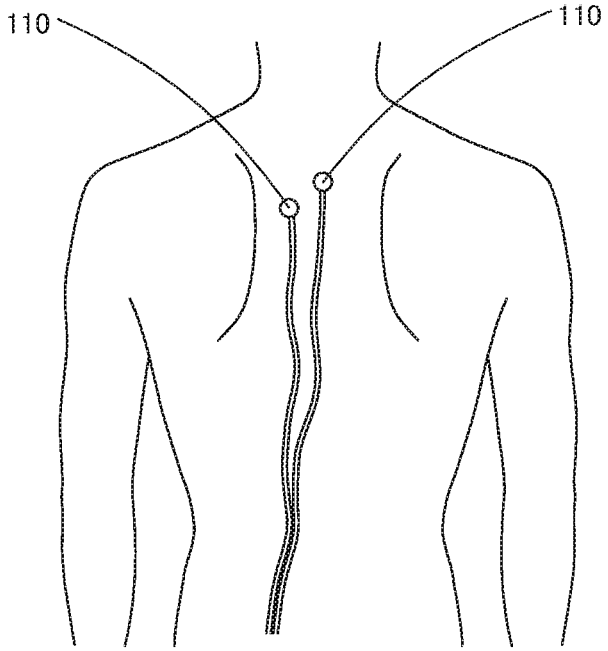
FIG. 12B is an explanatory view showing locations to place digital temperature-humidity sensors to demonstrate cooling effect.

As shown in FIG. 12A and FIG. 12B, digital temperature-humidity sensors 110 were attached to chest regions and back regions of testees, and inside-wear temperatures were measured during activities in each upper clothing.

The measurements were made under the following conditions.

<Environmental>

Indoor environment at 25 degrees Celsius and 50% humidity

<Physical>

The testees were asked to perform the following (a), (b) and (c) sequentially.

Condition (a): Complete rest for two minutes in no wind.

Condition (b): Complete rest for two minutes in a wind of approximately 0.5 m/s. from ahead of the testee Condition (c): Running for twenty minutes at a speed of 10 km/h in the same state of wind as (b).

Figure 13A:
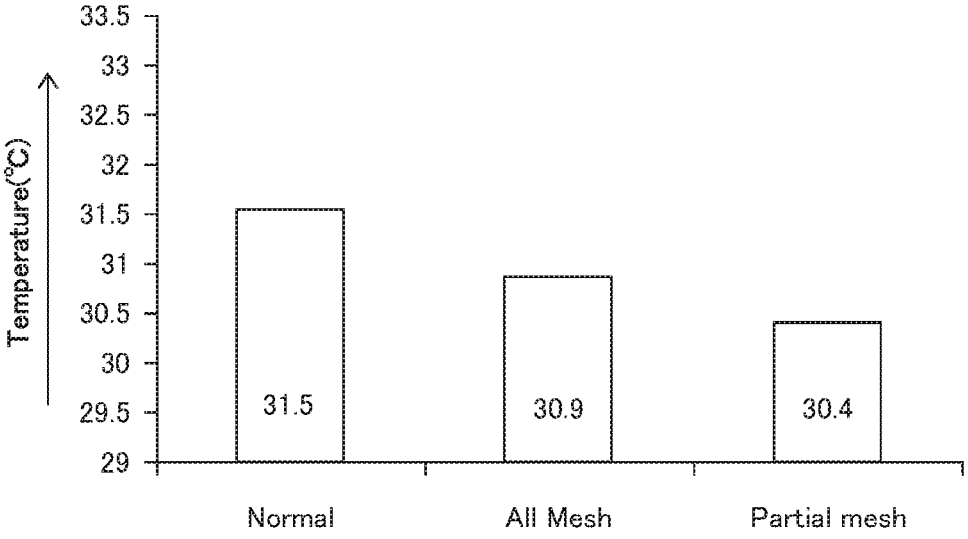
FIG. 13A is a graph which shows inside-wear temperatures at a chest region.
Figure 13B:
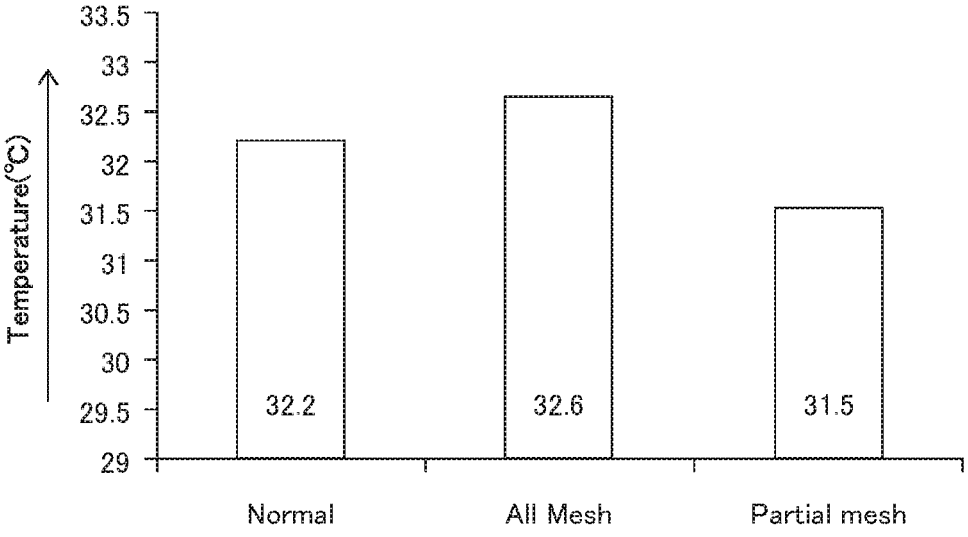
FIG. 13B is a graph which shows inside-wear temperatures at a back region.

Under these conditions, temperature measurements were made during the twenty-minute activities in the Condition (c) at an interval of thirty seconds and average values were obtained. Results are shown in FIG. 13A and FIG. 13B. FIG. 13A is a graph which shows temperature measurement results at the chest region. FIG. 13B is a graph which shows temperature measurement results at the back region.

As shown in these graphs, Partial Mesh can reduce temperature increase more than Normal and All Mesh.

Reasons why Partial Mesh can better reduce temperature increase than All Mesh which is more breathable may include differences in air flow inside the Partial Mesh upper clothing. Specifically, in Partial Mesh, it is likely that there are air streams inside the wear, i.e., that air enters from the front mesh regions due to running and other activities, does not very much escape from parts other than the mesh, and flows around, to reach and eventually flows out of the back mesh regions. In All Mesh, on the other hand, air comes in and out from any direction, which may not promote generation of the kind of air flow that may exist in Partial Mesh.

The inventors et., al. thus came to the earlier-mentioned finding, i.e., that when activities cause the body to bump against air, there are cases where air flow is increased to lead to greater reduction of inside-wear temperature increase by partial use of a fabric which has a high breathability value such as mesh material, rather than full use of the material in all parts of the upper clothing. Based on this, the inventors et., al came to the idea of a structure of sports upper clothing according to the present embodiment.

Specifically, according to the sports upper clothing offered by the present embodiment, the upper clothing is not made entirely of a material of a high breathability value, but rather, regional grading in breathability is provided to actively promote air flow inside the wear by using materials of different breathability values in various parts of the upper clothing. In particular, the sleeve 2 has its back portion 21 made of a fabric of a low breathable material, while the front portion 20 has a greater breathability value than the back portion 21. As a result, air which enters from the front portion 20 is less likely to flow directly out of the back portion 21.

In the present mode of embodiment, the sleeve 2 is made of a fabric having a low breathability value than those of the front body 10 and the back body 11. The front portion 20 is formed with a plurality of vent holes 22 so that the front portion 20 of the sleeve 2 has a greater breathability value than the back portion 21. The vent holes 22 in the front portion 20 can be formed, for example, by mechanical punching, laser, etc. performed to a material fabric of the front portion 20.

In the present mode of embodiment, the front body 10 has its regions, from the collar 13 across the shoulders and to a breast center, provided by a highly breathable portion 12 which has a greater breathability value than the back portion 21, and the sleeves 2 are attached to continue to the highly breathable portion 12. The highly breathable portion 12 has an inverted, generally triangular shape, for example.

In the present mode of embodiment, the sleeve 2 follows the raglan sleeve style, with slight differences from ordinary raglan sleeves. A specific difference of the sleeves 2 in the present mode of embodiment from ordinary raglan sleeves is that the sleeves 2 do not directly connect to the collar 13; instead, there is the highly breathable portion 12 between the collar 13 and the sleeve 2. In this mode of embodiment, the sleeve 2 includes a region from tip of the shoulder, across the chest, to the armpit. In other words, the sleeve 2 is a region which moves back and forth when the wearer swings his/her arm.

Also, as shown in FIG. 2, in the back body 11, a highly breathable portion 14 which has an inverted, generally triangular shape is provided in a region from the collar 13 to a place sandwiched by the scapulae. The highly breathable portion 14 has a greater breathability value than the back portion 21. The highly breathable portion 14 in the back body 11 is sewn to the sleeve 2 near the scapulae.

At the armpit region, stretchy portions 25 which are formed of a more stretchy fabric than the surrounds are provided for smooth movement of the sleeve 2. It should be noted here that in the present mode of embodiment, the stretchy portions 25 are provided near the armpit areas in the front body 10 as well as in the back body 11; however, the stretchy portion 25 may be provided only on the front body 10 side.

Each sleeve 2 has its sleeve end rimmed with a rim portion 26 which has a higher bending stiffness than the front portion 20 and the back portion 21. By providing the rim portion 26 which has a high bending stiffness, the sleeve end keeps its shape better and further, the sleeve end becomes heavier, which generates greater centrifugal force when the arm is swung, keeping the sleeve more open for air to come in.

Also, in the present mode of embodiment, the front body 10 has pipings 15 continuing to the sleeve ends, and pipings 16 continuing to the stretchy portions 25. Further, the back body 11 has pipings 15 continuing to the sleeve ends. These pipings 15, 16 increase stiffness and reduce shape collapse of the sleeve 2 when the arm is swung. This keeps space between the skin and the fabric for air to flow, helping the air which enters from the sleeve 2 flow toward the center of the athlete's body.

There is no limitation to fibers used in the fabric for making the upper clothing, and any fiber used for clothing in general may be employed. Examples include natural fibers such as cotton, linen and silk, and synthetic fibers such as polyester, nylon and rayon. From, a viewpoint of controlling breathability or bending stiffness, however, it is preferable that the sleeve 2 should be made of a polyester cloth for example.

The front portion 20 of the sleeve 2 has a breathability value of not smaller than 40 $cm^3/cm^2 \cdot s$. On the other hand, the back portion 21 of the sleeve 2 is made to have a relatively low breathability value of, for example, not greater than 20 $cm^3/cm^2 \cdot s$. The front portion 20 and the back portion 21 of the sleeve 2 should have a breathability value difference of not smaller than 20 $cm^3/cm^2 \cdot s$.

The front portion 20 and the back portion 21 may be made of the same fabric or different fabrics.

Figure 4A:
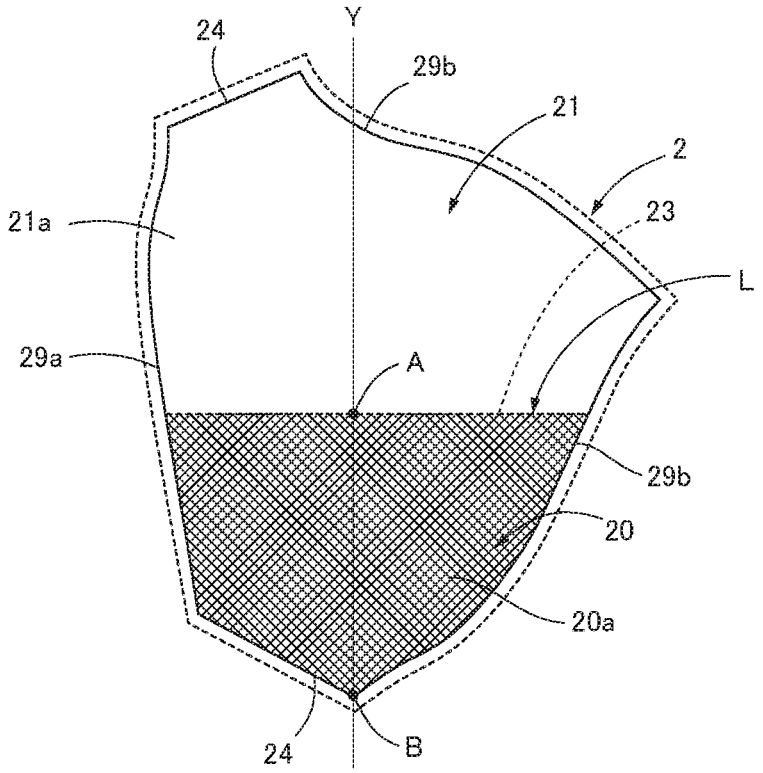
FIG. 4A shows an example where a front portion and a back portion are made of different fabrics; the figure is a plan view of a sleeve in a developed state.

FIG. 4A shows an example where the front portion 20 and the back portion 21 are made of different fabrics; the figure is a plan view of the sleeve 2 in a developed state. The front portion 20 uses a high breathability mesh material 20*a* provided by, for example, an eyelet mesh which has a breathability value of 250 $cm^3/cm^2 \cdot s$. The back portion 21 uses a low breathability cloth material 21*a* provided by, for example, a flat woven cloth of polyester which has a breathability value of 0 $cm^3/cm^2 \cdot s$. Namely, in the sleeve 2, the front portion 20 and the back portion 21 are made of different materials with a sleeve cap line 23 representing a border. The front portion 20 is entirely made of a high breathability mesh material 20*a* from its sleeve cap line 23 to the sleeve base line 24, and from, a sleeve end 29*a* to a sleeve root-end line 29*b*. In the present mode of embodiment, the sleeve root-end line 29*b* is a line to which an armhole of a main body is sawn. Note here that when the sports upper clothing according to the present mode of embodiment is laid flatly, a line representing an upper edge of the sleeve 2 is the sleeve cap line 23, whereas a line representing a lower edge of the sleeve 2 is the sleeve base line 24. Also, the back portion 21 is entirely made of a low breathability cloth material 21*a* from the sleeve cap line 23 to the sleeve base line 24, and from the sleeve end 29*a* to the sleeve root-end line 29*b*. In this case, a switching line L between the high breathability mesh material 20*a* and the low breathability cloth material 21*a* is provided by the sleeve cap line 23.

The sleeve 2 arranged as described above helps air enter from the front portion 20, and then prevents the air from flowing out of the back portion 21 once the air enters. The arrangement causes air, once it comes in the sleeve 2, to flow toward the chest and the back.

It should be noted here that the back portion 21 may be made of other cloth if it is provided by a fabric which has a smaller breathability value than the front portion 20. For example, there may be used a breathable knitted material which has a smaller breathability value than the high breathability mesh material.

As for breathability values of the front portion 20 and the back portion 21, an average breathability value of the entire portion is compared with each other: If the front portion 20 is made to have a greater breathability value than that of the back portion 21, the above-described effect is obtained. When measuring breathability values of the front portion 20 and the back portion 21 of the sleeve 2, there are specific regions for the measurement: The sleeve base line 24, which represents the lower edge of the front portion 20 when the sports upper clothing according to the present mode of embodiment is laid flatly, crosses the sleeve root-end line 29*b* at a point of intersection B. From this point of intersection B, a line Y is drawn perpendicularly to the sleeve cap line 23, making a point of intersection A. For the front portion 20, a breathability value of a region surrounded by the sleeve cap line 23, the sleeve base line 24, the line Y and the sleeve end 29*a* is taken as the average breathability value of the front portion 20. For the back portion 21, a breathability value of a region surrounded by the sleeve cap line 23, the sleeve base line 24, the line Y and the sleeve end 29*a* is taken as the average breathability value of the back portion 21. As for the average breathability value, a Frazir type breathability tester (JIS method), for example, may be used for evaluation.

Figure 4B:
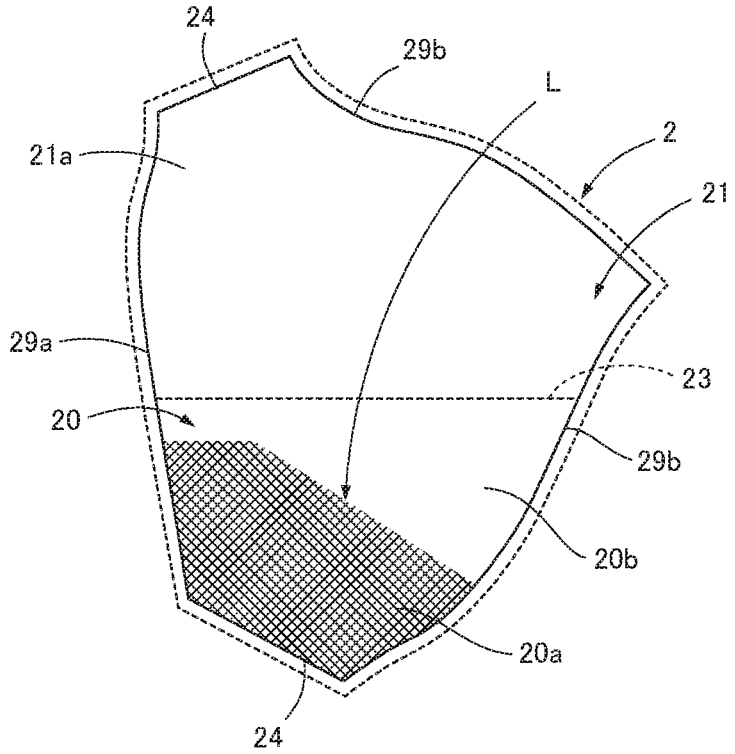
FIG. 4B shows an example where part of the front portion, and the back portion are made of different fabrics; the figure is a plan view of a sleeve in a developed state.

FIG. 4B snows an example where part of the front portion 20, and the back portion 21 are made of different fabrics; the figure is a plan view of the sleeve 2 in a developed state. As shown in FIG. 4B, the same material as used for the back portion 21 extends to a location slightly beyond the sleeve cap line 23 of the front portion 20. Then, the front portion 20 is made of a high breathability mesh material 20*a* from this location to the sleeve base line 24. The switching line L between the high breathability mesh material 20*a* and the low breathability cloth material 20*b* is extended from the sleeve end 29*a* toward the sleeve root-end line 29*b* generally in parallel with the sleeve cap line 23, and then from about a ¼ point, slanted to be closer to the sleeve base line 24.

As described, the front portion 20 is designed so that an average breathability value of its entire region is greater than an average breathability value of the entire region of the back portion 21 even if part of the front portion 20 is made of the same fabric as the back portion 21. As a result, the present mode of embodiment enables to achieve the earlier-described effect.

Figure 4C:
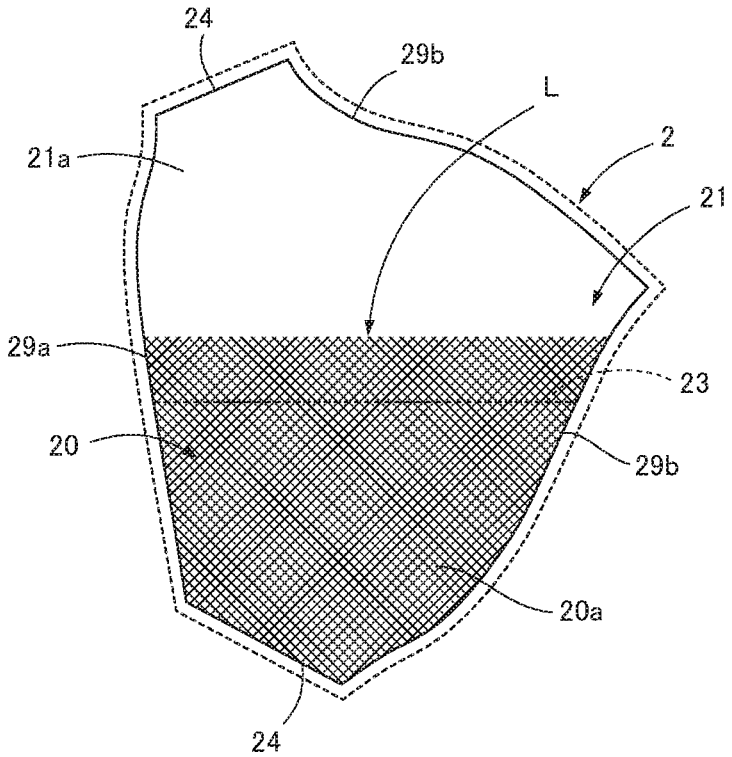
FIG. 4C shows an example where part of the back portion, and the front portion are made of different fabrics; the figure is a plan view of a sleeve in a developed state.

FIG. 4C shows an example where part of the back portion 21, and the front portion 20 are made of different fabrics; the figure is a plan view of the sleeve 2 in a developed state. As shown in FIG. 4C, the same material as used for the front portion 20, i.e., the high breathability mesh material 20*a*, extends to a location slightly beyond the sleeve cap line 23 of the back portion 21. Then, the back portion 21 is made of a low breathability cloth material 21*a* from this location to the sleeve base line 24. The switching line L between the high breathability mesh material 20*a* and the low breathability cloth material 21*a* becomes generally parallel with the sleeve cap line 23, from the sleeve end 29*a* toward the sleeve root-end line 29*b*, at a location beyond the sleeve cap line 23 toward the back portion 21.

As described, the front portion 20 is designed so that its average breathability value of the entire region is greater than an average breathability value of the entire region of the back portion 21 even if part of the back portion 21 is made of the same fabric as the front portion 20. As a result, the present mode of embodiment enables to achieve the earlier-described effect.

Figure 4D:
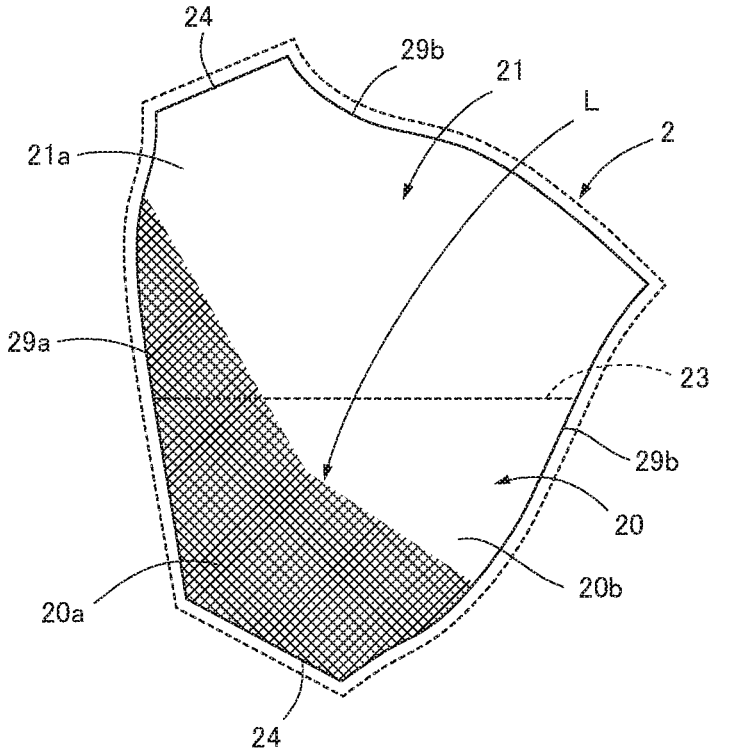
FIG. 4D shows an example where a high breathability mesh material is provided at a region across part of a front portion over part of a back portion; the figure is a plan view of a sleeve in a developed state.

FIG. 4D shows an example where the nigh breathability mesh material 20*a* is provided at a region beyond part of the front portion 20 to part of the back portion 21; the figure is a plan view of the sleeve 2 in a developed state. As shown in FIG. 4D, the switching line L between the high breathability mesh material 20*a* and the low breathability cloth material 20*b*, 21*a* runs obliquely from the sleeve end 29*a* of the back portion 21, across the sleeve cap line 23, and toward the sleeve root-end line 29*b*, reaching the sleeve root-end line 29*b* of the front portion 20. This means that the high breathability mesh material 20*a* is used in the front portion 20 and in the back portion 21. Except for a region near the sleeve end 29*a*, the back portion 21 is made of the low breathability cloth material 21*a*. Obliquely from about a half point of the sleeve root-end line 29*b* in the front, portion 20 toward the sleeve cap line 23, the low breathability cloth material 20*b* is used.

When the athlete (wearer) swings his/her arm down, the sleeve 2 shown in FIG. 4D helps air enter from the front portion 20 while preventing the air from flowing out of the back portion 21 once entered, As described, the front portion 20 is designed so that its average breathability value of the entire region is greater than an average breathability value of the entire region of the back portion 21 even if part of the back portion 21 is made of the same fabric as the front portion 20. As a result, the present mode of embodiment enables to achieve the earlier-described effect.

Figure 4E:
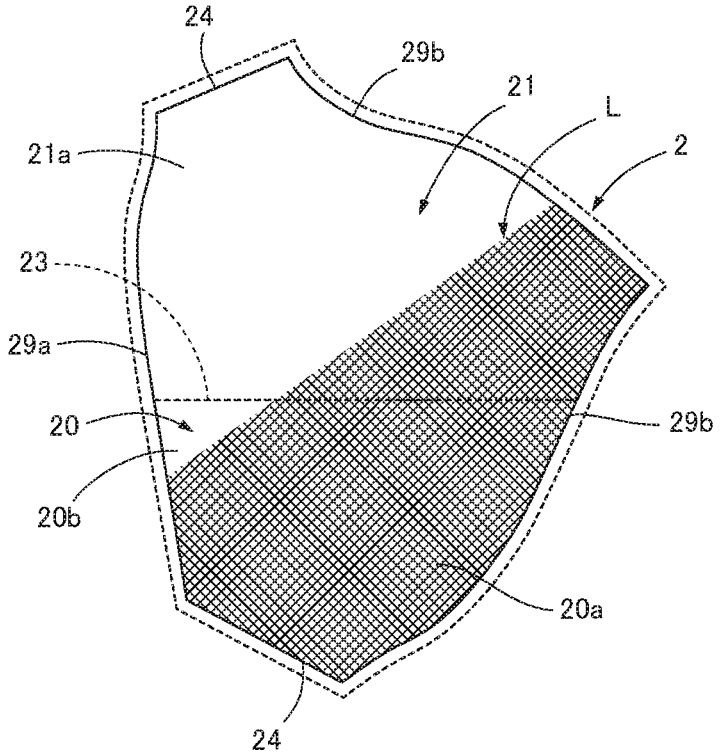
FIG. 4E shows an example where a high breathability mesh material is provided at a region across part of the front portion and part of the back portion; the figure is a plan view of a sleeve in a developed state.

FIG. 4E shows an example where the high breathability mesh material 20*a* is provided at a region across part of the front portion 20 to part of the back portion 21; the figure is a plan view of the sleeve 2 in a developed state. As shown in FIG. 4E, the switching line L between the high breathability mesh material 20*a* and the low breathability cloth material 20*b*, 21*a* runs obliquely from the sleeve root-end line 29*b* of the back portion 21, then across the sleeve cap line 23 and toward the sleeve end 29*a* of the front portion 20, reaching the sleeve end 29*a* of the front portion 20. This means that the high breathability mesh material 20*a* is used in the front portion 20 and in the back portion 21. A proximity region enclosed by the sleeve end 29*a*, the sleeve cap line 23 and the switching line L in the front portion 20 is made of the low breathability cloth material 20*b*. A proximity region enclosed by the sleeve root-end line 29*b*, the sleeve cap line 23 and the switching line L in the back portion 21 adjacent to the sleeve cap line 23 and the sleeve root-end line 29*b* is made of the high breathability mesh material 20*a*.

As shown in FIG. 4E, the front portion 20 is designed so that an breathability value of the entire region is greater than an breathability value of the entire region of the back portion 21 even if part of the back portion 21 is made of the high breathability mesh material 20*a* and part of the front portion 20 is made of the low breathability cloth material 20*b*. As a result, the present mode of embodiment achieves the earlier-described effect.

Figure 4F:
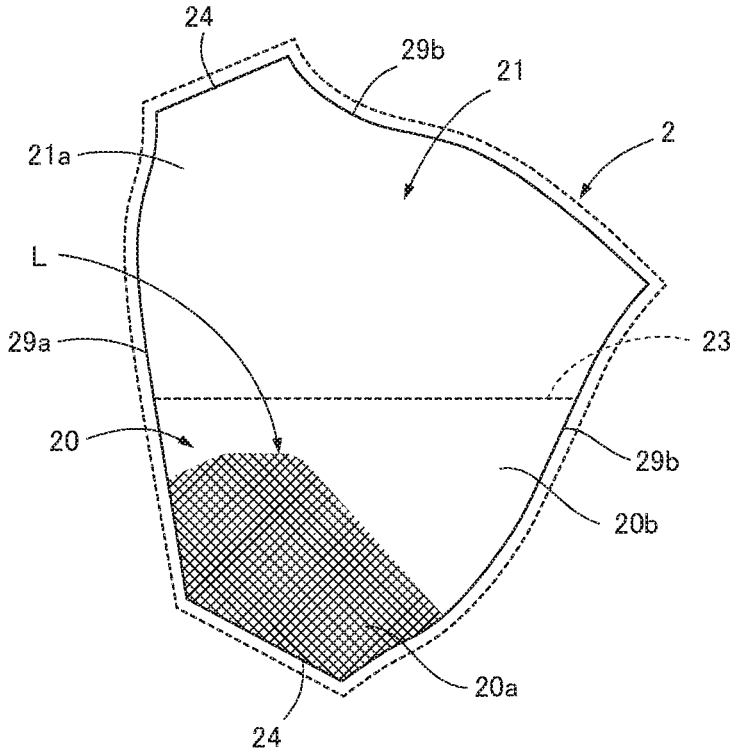
FIG. 4F shows an example where part of the front portion, and the back portion are made of different fabrics; the figure is a plan view of a sleeve in a developed state.

FIG. 4F shows an example where part of the front portion 20, and the back portion 21 are made of different fabrics; the figure is a plan view of the sleeve 2 in a developed state. As shown in FIG. 4F, the same material as used for the back portion 21 extends to a location slightly beyond the sleeve cap line 23 of the front portion 20. Then, the front portion 20 is made of the high breathability mesh material 20*a* from this location to the sleeve base line 24. The switching line L between the high breathability mesh material 20*a* and the low breathability cloth material 20*b* is formed as a curve from the sleeve end 29*a*, coming closer to the sleeve cap line 23, and then away from about a ⅓ point, toward the sleeve root-end line 29*b*.

As described, the front portion 20 is designed so that its average breathability value of the entire region is greater than an breathability value of the entire region of the back portion 21 even if part of the front portion 20 is made of the same fabric as the back portion 21. As a result, the present mode of embodiment achieves the earlier-described effect.

Figure 4G:
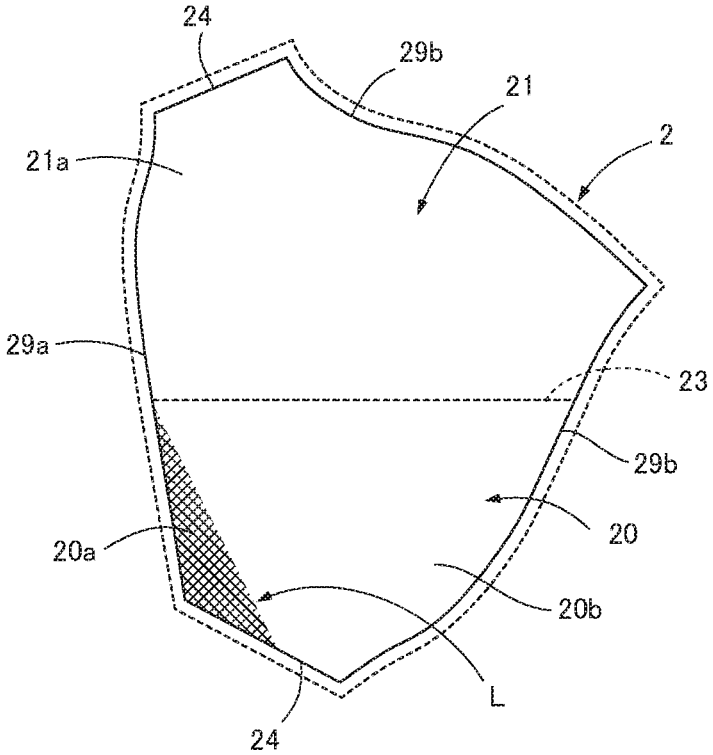
FIG. 4G shows an example where a high breathability mesh material is provided at part of the front portion; the figure is a plan view of a sleeve in a developed state.

FIG. 4G shows an example where the high breathability mesh material 20*a* is provided at part, of the front portion 20; the figure is a plan view of the sleeve 2 in a developed state. As shown in FIG. 4G, the high breathability mesh material 20*a* is provided at near the sleeve end 29*a* in the front portion 20. The rest, of the front portion 20, and the back portion 21 are made of the low breathability cloth material 20*b*, 20*a*. The high breathability mesh material 20*a* becomes narrower from the sleeve base line 24 toward the sleeve cap line 23.

As shown in FIG. 4G, the front portion 20 is partially made of the high breathability mesh material 20*a*. With this, a design is made so that an average breathability value of the entire region of the front portion 20 is greater than an average breathability value of the entire region of the back portion 21. As a result, the present mode of embodiment achieves the earlier-described effect.

In the next mode of embodiment, the front portion 20 and the back portion 21 are made of the same fabric, but the front portion 20 is formed with a plurality of vent holes 22 so that the front portion 20 has a greater breathability value than the back portion 21.

Figure 4H:
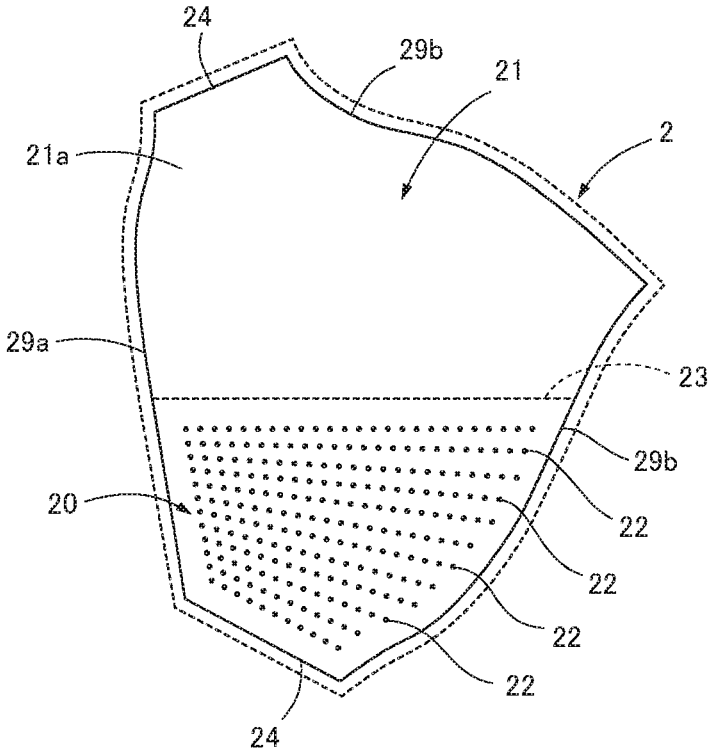
FIG. 4H shows a layout example of a plurality of vent holes; the figure is a plan view as a development of a sleeve.

FIG. 4H shows an example of layout of a plurality of vent holes 22; the figure is a plan view as a development of the sleeve 2. As shown in FIG. 4H, the sleeve 2 is made of a low breathability cloth material, with the front portion 20 provided with the vent holes 22 of the same diameter, arranged in a regular pattern at a uniform hole density.

The sleeve 2 arranged as described above helps air enter from the front portion 20, and then prevents the air from flowing out of the back portion 21 once the air enters. The arrangement causes air, once it comes in the sleeve 2, to flow toward the chest and the back.

The front portion 20 and the back portion 21 of the sleeve 2 have a breathability value difference of not smaller than 23 $cm^3/cm^2 \cdot s$.

Of the front body 10 and the back body 11, regions other than the highly breathable portions 12, 14 have a breathability value of not smaller than 100 $cm^3/cm^2 \cdot s$.

The highly breathable portions 12, 14, which are more breathable than non highly breathable portions of the front body 10 and the back body 11, have an breathability value of not smaller than 200 $cm^3/cm^2 \cdot s$ for example.

A breathability value of a fabric can be varied by knitting method, weaving method, the number of layers (single-layer, double-layer or more), etc. For example, when lowering the breathability value by way of weaving method, fabric density (warp density and weft density) may be increased as much as possible. When changing breathability value by way of weaving method, it is possible to control the density by changing the amount of yarn in the warp and in the weft, and other means. Decreasing the knitting/weaving density will rise breathability, whereas increasing the knitting/weaving density will lower breathability. It is also possible to change the breathability value through such treatment as applying film resin coating onto the fabric. It is also possible to change the breathability through such treatment as laser, applying chemicals and impregnation.

If the fabric is provided by a woven cloth, the cloth may be, for example, plain weave, twill weave, satin weave, and jacquard weave as a combination of these.

Each vent hole 22 in the front portion 20 of the sleeve 2 is generally circular, for example, in a plan view, having a diameter selected from a range of 0.6 mm through 5 mm. Air can enter more easily from the vent holes 22 if the diameter is not smaller than 0.6 mm. On the other hand, the diameters not greater than 5 mm make skin exposure from the vent holes 22 less conspicuous.

Figure 4I:
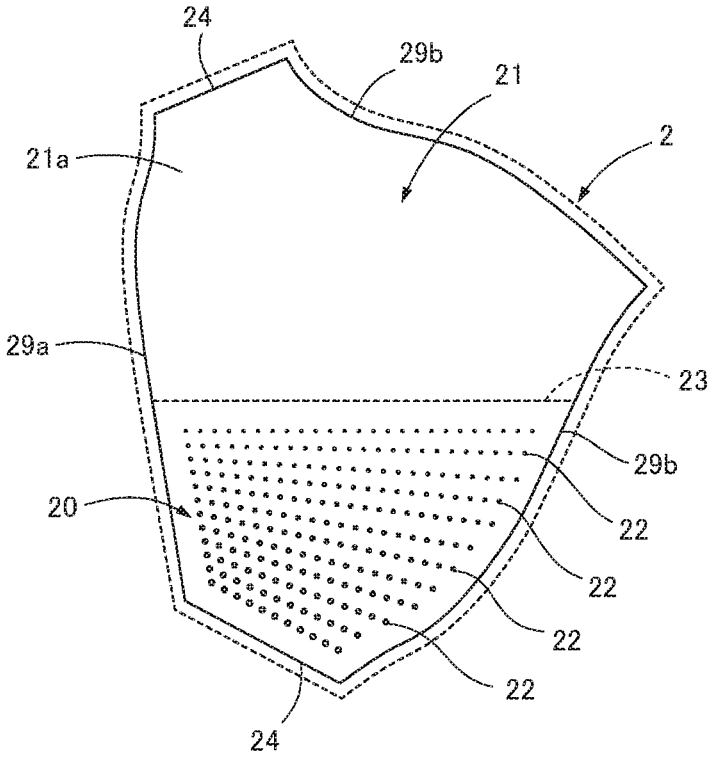
FIG. 4I shows an example of suitable layout of a plurality of vent holes; the figure is a plan view as a development of a sleeve.

FIG. 4I shows an example of suitable layout of a plurality of vent holes 22; the figure is a plan view as a development of the sleeve 2. In the sleeve 2 shown in FIG. 4I, the vent holes 22 nave gradually smaller diameters from a sleeve base line 24 toward a sleeve cap line 23 of the sleeve 2. In other words, the vent holes 22 closer to the sleeve cap line 23 have a smaller diameter.

A breathability value of a fabric which is formed with vent holes can be regarded as an average breathability value. The average breathability value used herein is a value obtained as a total area of the holes per a unit area of the fabric. The greater the total area of the holes, the greater is the breathability value.

Figure 4J:
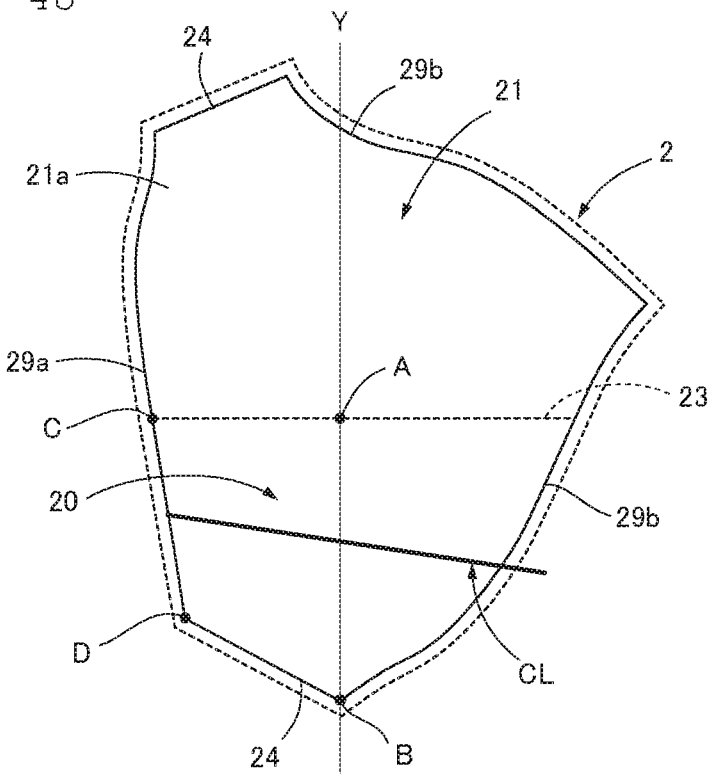
FIG. 4J shows a center line in up-down direction in the front portion of a sleeve; the figure is a plan view as a development of the sleeve.

FIG. 4J is a development view which shows a centerline CL in an up-down direction in the front portion 20 of the sleeve 2. Following FIG. 4J, description will be made for the centerline CL in the up-down direction of the front portion 20. In the present embodiment, the centerline CL is defined as follows: A point of intersection between the sleeve base line 24 of the front portion 20 and the sleeve root-end line 29*b* is called B, From this point of intersection B, a line Y is drawn perpendicularly to the sleeve cap line 23, making a point of intersection A. A point of intersection between the sleeve base line 24 and the sleeve end 29*a* is called D. A point of intersection between the sleeve cap line 23 and the sleeve end 29*a* is called C. The two points of intersection A and B are connected with each other by drawing a line segment, the middle point of which and a middle point of a line segment connecting the points of intersection C and D are connected with each other, to obtain the centerline CL.

Figure 4K:
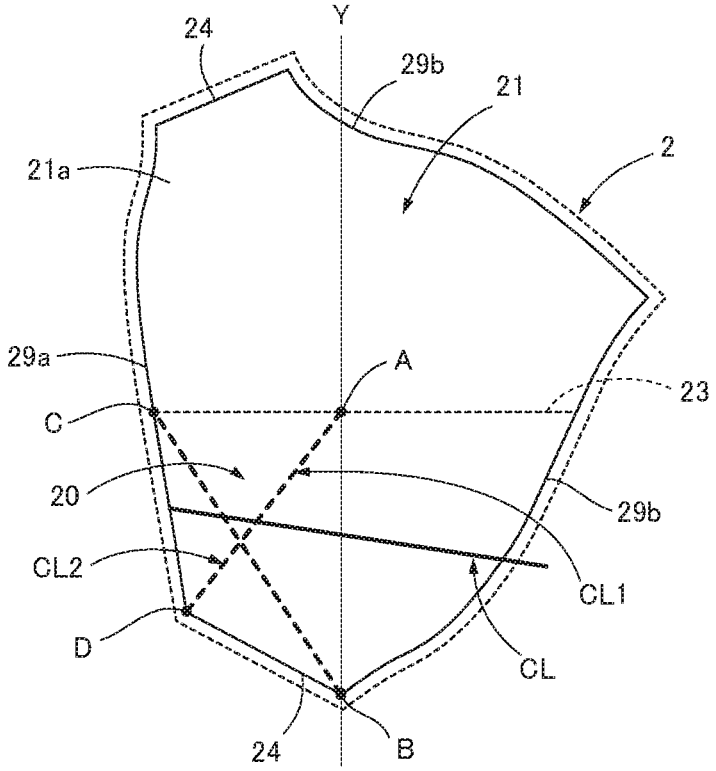
FIG. 4K shows an example of the centerline when an arm swinging angle is changed; the figure is a plan view as a development of a sleeve.

The centerline CL shown in FIG. 4J is a centerline when the athlete swings his/her arm generally horizontally: The centerline location moves as the athlete swings his/her arm at different angles. FIG. 4K shews an example of the centerline when the arm swinging angle is changed. A centerline CL1 when the arm is swung down from a raised state is represented by a line connecting the points of intersection A and D. Also, a centerline CL2 when the arm is swung up from a down position is represented by a line connecting the points of intersection B and C. Depending upon a type of arm swinging motion the athlete will perform, the centerline of the sleeve 2 is determined, and then a layout is determined accordingly to the centerline, with a breathability value in consideration.

When the arm is swung, it is likely that a relatively greater amount of air will be hit by a region of the front portion 20 in the sleeve 2 which is lower than a centerline drawn across the up-down direction of the front portion 20 whereas a relatively small amount of air will be hit by a region higher than the centerline drawn across the up-down direction. For this reason, it is probable that greater breathability in a region close to the back portion 21 (sleeve cap line 23) in the front portion 20 will promote escaping of the air which was once taken from the region lower than the centerline across the up-down direction of the front portion 20, rather than introducing air therefrom. By arranging the vent holes 22 so that their diameter will be gradually smaller from the sleeve base line 24 side toward the sleeve cap line 23 side of the front portion 20, it is expected that there will be balanced functions between taking air in and preventing the air from escaping.

By arranging in such a way that a region closer to the sleeve base line, which is a region lower than the centerline in the up-down direction in the front portion 20, will have a greater average breathability value than a region closer to the sleeve cap line, which is a region higher than the centerline, it is expected that there will be balanced functions between taking air in and preventing the air from escaping.

The vent holes 22 may have whatever shape in plan view; not only circles, but any polygonal shapes such as triangles, rectangles and others, and ovals as well are usable. Particularly preferable is a hole extending in up-down direction.

A reason behind this is that the air hit by the front portion 20 of the swinging sleeve 2 is likely to flow upward along the front portion 20. If the vent hole 22 is formed into an oval shape extending in up-down direction, it is expected that a greater amount of upward lifting air will be taken than cases where the vent hole 22 is circular of the same area.

Figure 4L:
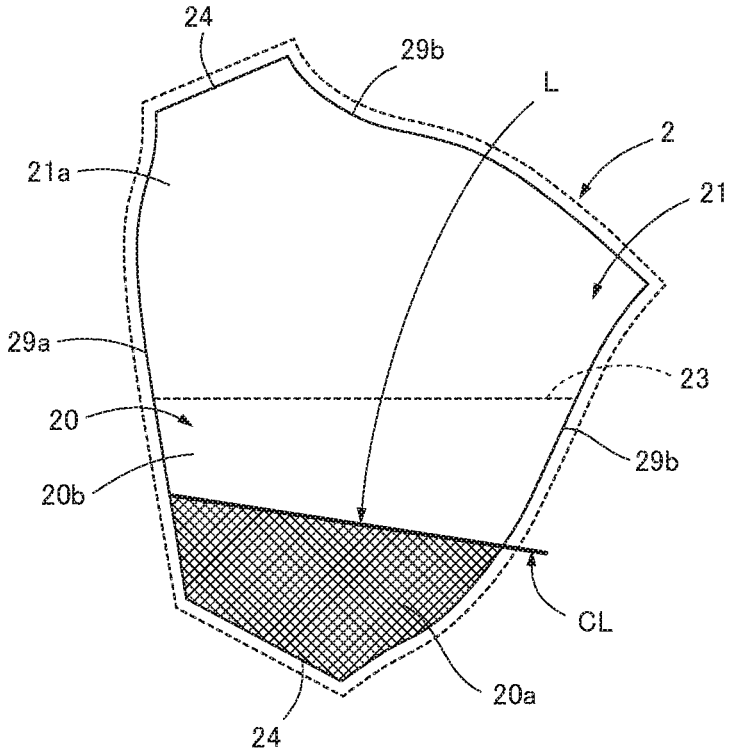
FIG. 4L shows an example where an area of the front portion from the centerline CL to the sleeve base line is made of a different fabric from that of the rest of the sleeve; the figure is a plan view of a sleeve in a developed state.
Figure 4M:
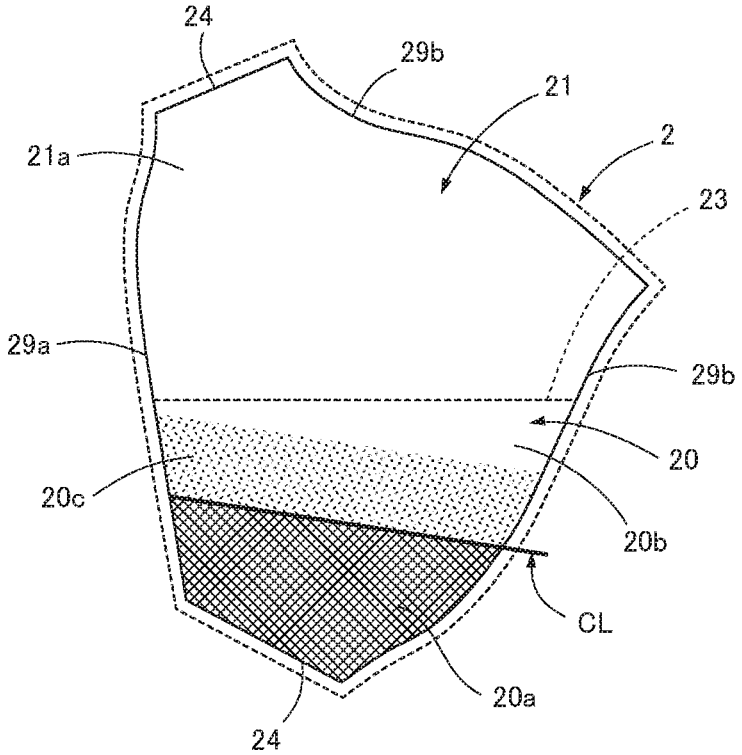
FIG. 4M shows an example where part of the front portion is made of a different fabric from that of the rest of sleeve; the figure is a plan view of a sleeve in a developed state.

FIG. 4L and FIG. 4M show examples of the sleeve 2 suitable for cases where the athlete swings his/her arm generally horizontally. FIG. 4L shows an example where an area of the front portion 20 from the centerline CL to the sleeve base line 24 is made of a different fabric from that of the rest of the sleeve 2; the figure is a plan view of the sleeve 2 in a developed state. The area of the front portion 20 from the centerline CL to the sleeve base line 24 uses a high breathability mesh material provided by, for example, an eyelet mesh which has an breathability value of 250 $cm^3/cm^2 \cdot s$. An area 20*b* from the centerline CL to the sleeve cap line 24, and the back portion 21 are made of a low breathability cloth material provided by, for example, a flat woven cloth of polyester which has a breathability value of 0 $cm^3/cm^2 \cdot s$. In other words, the sleeve 2 is made of different materials, with the centerline CL representing the borderline between the materials. In this case, the switching line between the high breathability mesh material 20*a* and the low breathability cloth material 20*b* is provided by the centerline CL.

FIG. 4M shows an example where part of the front portion 20 is made of a different fabric from that of the rest of the sleeve 2; the figure is a plan view of the sleeve 2 in a developed state. A region of the front portion 20 from the centerline CL to the sleeve base line 24 is made of the high breathability mesh material 20*a*. A region of the front portion 20 from the centerline CL to a line extending in generally parallel with the centerline CL in a region near the sleeve cap line 23 is made of a mesh material 20*c* which has a smaller breathability value than the high breathability mesh material 20*a* but a greater breathability value than the back portion 21. A region from the mesh material 20*c* to the sleeve cap line 23, and the back portion 21 are made of the low breathability cloth material 20*b*, 21*a*. In the present mode of embodiment, breathability value is changed in a stepped fashion.

Figure 4N:
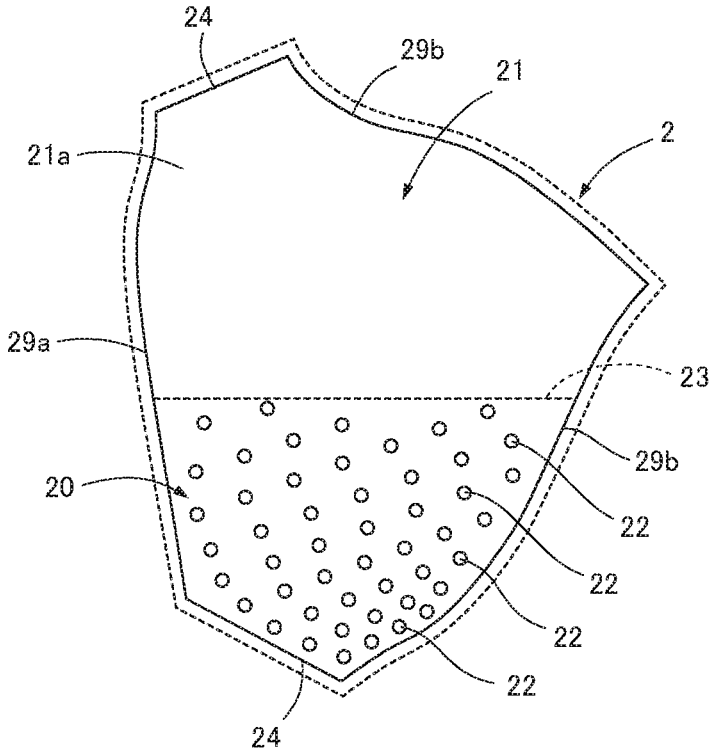
FIG. 4N shows an example where the front portion is provided with vent holes; the figure is a plan view as a development of a sleeve.

FIG. 4N shows an example where the front portion 20 is provided with the vent holes 22; the figure is a plan view as a development of the sleeve 2. As shown in FIG. 4N, the front portion 20 and the back portion 21 are made of the same fabric, with the front portion 20 provided with the vent holes 22 in its entire face. The vent holes 22 are formed at different density, coarsely in an area closer to the sleeve cap line 23 and increasingly densely in a region near the sleeve base line 24.

In many activities including running and tennis in which the athlete swings his/her arms in a certain direction (s) by, e.g., flexing, extending, abducting, adducting his/her shoulder joints, the arm-swinging actions cause significant flapping of the sleeve 2.

Such a significant flapping of the sleeve 2 can collapse the shape of the sleeve 2 when the arm is moved, if the sleeve 2 has a low bending resistance. In this case, a large area of the fabric of the sleeve 2 will cling around the skin, collapsing the space for the air to flow through and reducing the air that flow in from the mouth of the sleeve. With this in mind, in the present mode of embodiment, a fabric which has a high bending resistance is used for the sleeve 2.

A suitable range of the bending resistance for the fabric which provides the front portion 20 and the back portion 21 of the sleeve 2 is 20 mm through 150 mm. Use of a fabric which has a bending resistance in the range of 20 mm through 150 mm ensures that the sleeve 2 does not easily loose its shape, provides air paths, and improves ventilation, leading to reduced discomfort from the fabric touching on the skin. In other words, a bending resistance smaller than 20 mm causes easy collapse of the shape, so the bending resistance should preferably be 20 mm. or greater. On the contrary, a bending resistance greater than 150 mm increases discomfort, so the bending resistance should preferably be 150 mm or less.

It should be noted here that the bending resistance values are measured in accordance with JIS L 1096A Method (45-degree cantilever method).

The sleeve, in general, is classified into: set-in sleeve which is sewn around an arm hole made across a shoulder to an armpit in the body formed from; and raglan sleeve which is sewn to the body to cover a region from a neck (collar region) to an arm (sleeve hem). In the present mode of embodiment, the raglan sleeve is taken as a basis, and there is provided the highly breathable portion 12 which has a shape of an inverted, generally triangular piece in the front body 10, between the collar 13 and the sleeve 2; further, a fabric which has a high bending stiffness is utilized across a region from the sleeve 2 to a breast center area which is provided by the highly breathable portion 12. The arrangement ensures air flow, allowing air to flow from the sleeve 2 toward the collar 13, and it is expected to improve ventilation.

In order to take an increased amount of air from the sleeve end based on the arm-swinging movement, it is effective to increase the area of the sleeve 2.

Anatomically, the shoulder-around and the base of the arm are larger in circumference than the upper arm where the sleeve end is located. Accordingly in general apparel, the shoulder-around indicated in FIG. 1 with alternate long and snort dash lines has a larger diameter than that of the sleeve end. However, a consideration from a convection point of view with a purpose of introducing a greater amount of air from the sleeve end to the inside of the wear, it is preferable that two line segments 23*a*, 24*a* of the sleeve cap line 23 and the sleeve base line 24 be parallel with each other, or the sleeve cap line 23 and the sleeve base line 24 become farther away from each other as they come closer to the sleeve end. This allows more air to enter from the sleeve end for increased convection, leading to lower inside-wear temperatures.

As shown in FIG. 1, the front portion 20 of the sleeve 2 has a sleeve end which, in a front view, exposes a sleeve end region of the back portion 21 of the sleeve 2. For efficient air intake from the sleeve end, it is effective to cut the front portion 20 of the sleeve 2 shorter than the back portion 21 with respect to its longitudinal axis. This enables the back portion 21, which is on the back of the sleeve 2, to be hit by a greater amount of air with respect to the arm forward-swinging direction, for promoted convection. The sleeve end may be cut into a triangular shape as shown in FIG. 1, or whatever shape such as semi-circular and rectangular, as far as it allows exposure of the sleeve end region of the back portion 21.

In the mode of embodiment described above, the front portion 20 and the back portion 21 of the sleeve 2 are made of the same fabric and the front portion 20 is formed with a large number of the vent holes 22 to make the front portion 20 have a greater breathability value than the back portion 21; however, the method for making breathability value differences is not limited to this. For example, the front portion 20 may be made of a mesh fabric while the back portion 21 is made of a denser woven cloth than the mesh, to increase a breathability value of the front portion 20 than that of the back portion 21.

Also in the above-described mode of embodiment, the sleeves 2 are based on raglan sleeves and the sleeves 2 are placed at regions moved by the arms' swinging motion; however, the present invention is applicable also to normal set-in sleeves and other variations.

Embodiment Example

Figure 5:
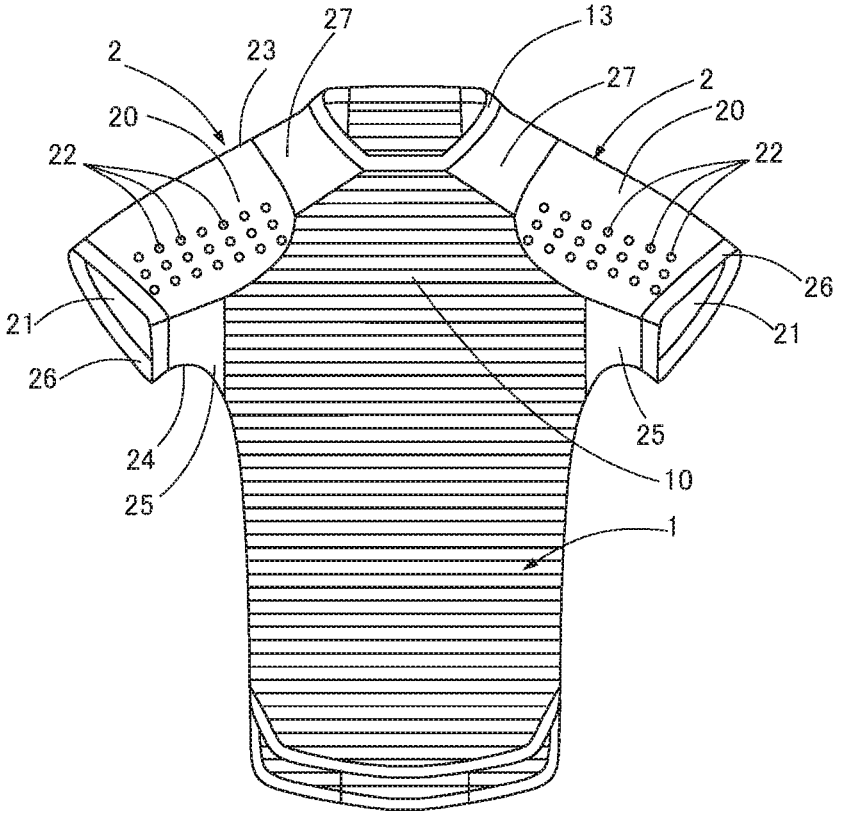
FIG. 5 is a front view of sports upper clothing according to an embodiment example of the present invention.
Figure 6:
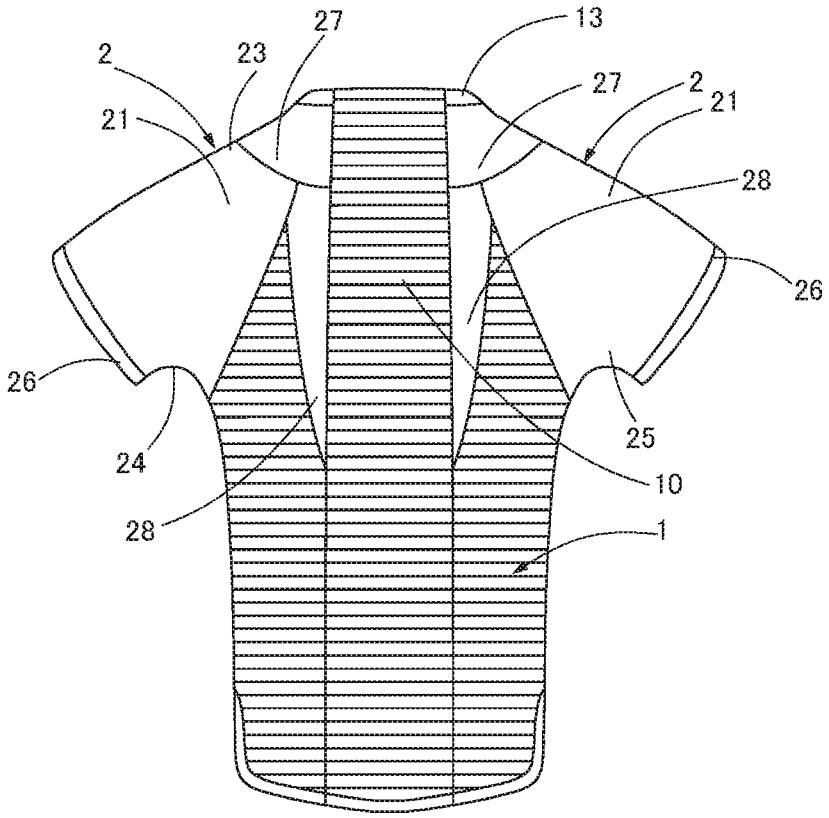
FIG. 6 is a rear view of the sports upper clothing according to the embodiment example of the present invention.

Next, a more specific Embodiment Example of the present invention will be described with reference to FIG. 5 and FIG. 6. As shown in FIG. 5 and FIG. 6, upper clothing according to this Embodiment Example is composed of such parts as a main body 1 which has a front body 10 and a back body 11; sleeves 2; a collar 13; and stretchy portions 25, 27, 28.

It should be noted here that the sleeve 2 in this Embodiment Example includes a region from the tip of the shoulder, across the chest, to the armpit, i.e., a portion which moves back and forth when the arm is swung.

In this Embodiment Example, the back body 11 has a slightly longer hem region than the front body 10.

Breathability value and blending ratio for each of the parts are as follows:

<Breathability Value>

The sleeve 2, the front portion 20: 40 $cm^3/cm^2 \cdot s$

The sleeve 2, the back portion 21: 17 $cm^3/cm^2 \cdot s$

The front body 10 and the back body 11: 205 $cm^3/cm^2 \cdot s$ the stretchy portions 25, 27 and 28: 89 $cm^3/cm^2 \cdot s$ The breathability values were determined with a Frazir type breathability value (breathability) tester, through JIS L 1096 "Testing methods for woven and knitted fabrics".

<Blending ratio>

The sleeve 2, the front portion 20: Polyester 100%

The sleeve 2, the back portion 21: Polyester 100%

The front body 10 and the back body 11: Polyester 100%

The stretchy portions 25, 27 and 28: Polyester 90%, Polyurethane 10%

Note that the front portion 20 and the back portion 21 of the sleeve 2 are each provided by a piece of 100% polyester woven cloth of the same density, but the front portion 20 is provided with a plurality of the vent holes 22, so there is an breathability value difference between the two. Also, the sleeve 2, the front body 10 and the back body 11 are made of the same 100% polyester woven cloth; but the sleeve 2 is made to have a higher density than the front body 10 and the back body 11 to create a breathability value difference.

The fabric for the front portion 20 and the back portion 21 of the sleeve 2 have a bending resistance of 23 mm.

The sleeve 2 and the stretchy portion 27 are sewn to the front body 10 near the chest portion. In the present Embodiment Example, the collar 13 does not directly continue to the sleeve 2; instead, the stretchy portion 27 is provided between the collar 13 and the sleeve 2.

In this Embodiment Example, the sleeve cap line 23 and the sleeve base line 24 are parallel to each other.

As shown in FIG. 5, the front portion 20 of the sleeve 2 has its sleeve end cut shorter than the back portion 21 with respect to its longitudinal axis. The sleeve end of the sleeve 2 has a rim portion 26 which has a higher bending stiffness than the front portion 20 and the back portion 21.

Comparative Example 1

Figure 7:
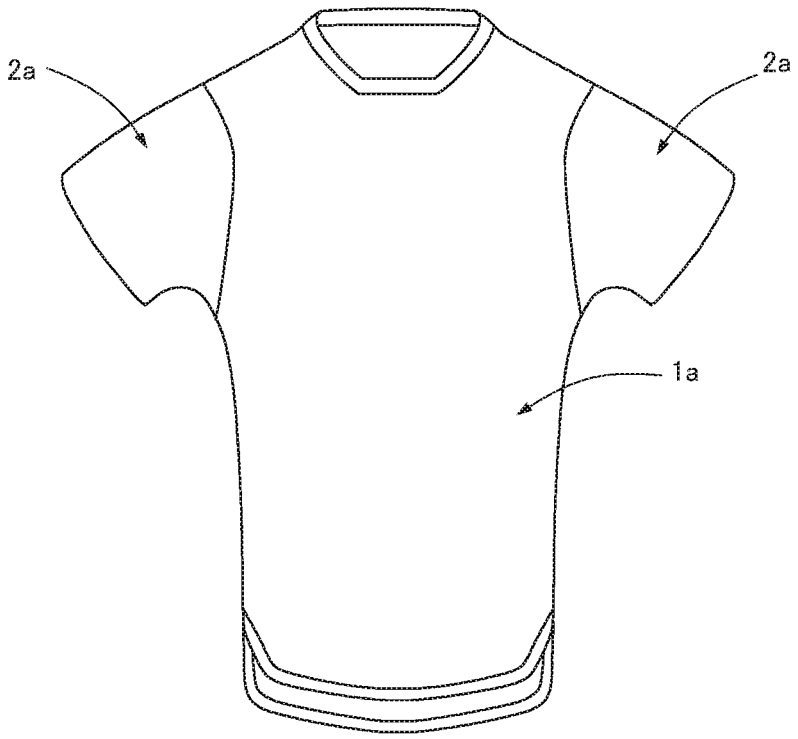
FIG. 7 is a front view of sports upper clothing as a comparative example to the present invention.

As shown in FIG. 7, Comparative Example 1 is an ordinary T-short of a set-in sleeve type, and has a main body 1*a*, and sleeves 2*a* made of a fabric having the same breathability value of 113.5 $cm^3/cm^2 \cdot s$.

Comparative Example 2

Comparative Example 2 is the same as the Embodiment Example, differing only in that the vent holes 22 in the front portion 20 of the sleeve 2 of the Embodiment Example are closed with non-breathable tape.

The Embodiment Example, and Comparative Examples 1 and 2 were worn by testees, and measurements were made for the testees' inside-wear temperatures and their feelings. A total of ten testees attended the demonstration. Each testee simulated tennis swings. A set of one high-ball hitting action and three low-ball hitting actions were repeated ten times, for about 80 seconds, resulting in a total of forty continuous swings.

Figure 8:
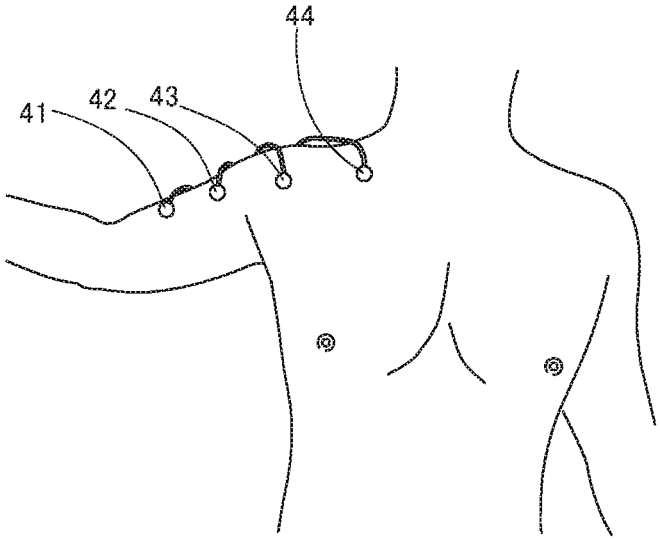
FIG. 8 is an explanatory view showing locations to place digital temperature-humidity sensors to demonstrate cooling effect of the present invention.

Test environment included a temperature of 5 degrees Celsius and a humidity of 40%, with no wind. As shown in FIG. 8, the measurements included temperatures using four digital temperature-humidity sensors (manufactured by Syscom Co., Ltd.) attached in a region from the arm through the neck base. A digital temperature-humidity sensor 41 was attached onto an upper arm biceps region, a digital temperature-humidity sensor 42 was attached onto a deltoid muscle region, a digital temperature-humidity sensor 43 was attached onto a shoulder joint region, and a digital temperature-humidity sensor 44 was attached onto a chest top region.

As for calculation, an average value was obtained for measurements during the first ten seconds of the swinging exercise and measurements during the last ten seconds of the swinging exercise for each of the four measuring points, and a difference between the two average values was obtained for the four points. In other words, while the temperature is increased by the swinging practice of about 80 seconds, the temperature right after the exercise was started and the temperature right before the exercise was finished were compared in each of Embodiment Example, Comparative Example 1 and Comparative Example 2, to see how much the increase in the temperature was to evaluate effectiveness in reducing temperature increase.

Results showed that the temperature increase found after the exercise was +0.61 degrees Celsius in the Embodiment Example of the present invention, +1.42 degrees Celsius in Comparative Example 1, and +1.34 degrees Celsius in Comparative Example 2, Comparative Example 1 showed the greatest temperature increase. Comparative Example 2, in which wind was not allowed in from the sleeves, showed a temperature increase much smaller than Comparative Example 1 yet the temperature increase was about two times that of the Embodiment Example.

From these results, it was demonstrated that the Embodiment Example is able to lower the inside-wear temperature than Comparative Example 1 and Comparative Example 2.

Also, the demonstration with the Embodiment Example indicates that if the back portion 21 of the sleeve 2 has a breathability value of at least 17 $cm^3/cm^2 \cdot s$ or lower, increased air flow is expected from reduced amount escaping air which was once entered from a front portion 10 of the sleeve 2 and from the sleeve end.

Also, in addition to providing the back portion 21 with a low breathability value as described above, the front portion 20 may be given a higher breathability value than the back portion 21 by at least by 23 $cm^3/cm^2 \cdot s$, then it is expected that a sufficient amount of air is introduced from the front portion 20 for increased air flow.

Next, feeling perceived by the ten testees were analyzed. They were asked to evaluate on a Visual Analogue Scale (VAS) in a questionnaire, with "coolest" being 1 and "hottest" being 10. As a result, the Embodiment Example received 4.3 points, Comparative Example 1 received 7.6 points and Comparative Example 2 received 6.4 points. The results revealed that the testees did not feel increase in the inside-wear temperature in the Embodiment Example.

In the Embodiment Example described above, tennis wear was taken for description; however, the invention will be effective not only in tennis wear but also in jogging wear for example, in which arm swinging action may be gentler. Therefore, the present invention is applicable to upper clothing for a variety of sports.

In the Mode of Embodiment Example given above, description was made for half-sleeve upper clothing but the present invention is applicable also to shorter sleeve upper clothing and long-sleeve upper clothing.

All of the Embodiment Examples disclosed herein are to show examples, and should not be considered as of a limiting nature in any way. The scope of the present invention is identified by the claims and is not by the descriptions of the Embodiment Examples given hereabove, and it is intended that the scope includes all changes falling within equivalents in the meaning and extent of the Claims.

What is claimed is:

1. Sports upper clothing comprising:

a front body;

a back body; and sleeves extending from the front and back bodies, wherein each sleeve includes a front portion located on a same side as the front body and extending from a distal end to a proximal end of each respective sleeve, and a back portion located on a same side as the back body and extending from the distal end to the proximal end of each respective sleeve, wherein the back portion is entirely formed of a fabric having a first breathability value as measured in $cm^3/cm^2 \cdot s$ and the front portion has a second breathability value, that is greater than the first breathability value, to allow air to enter from the front portion as a wearer swings their arm then cause the air to hit the back portion which is made of the fabric having the first breathability value, resulting in an increased air flow toward the center of the wearer's body, wherein an average breathability value of the front body is greater than the second breathability value of the front portion.

2. The sports upper clothing according to claim 1, wherein the front portion and the back portion of each sleeve are made of the same fabric, and the front portion is provided with a plurality of vent holes.

3. The sports upper clothing according to claim 2, wherein the fabric providing the front portion and the back portion of each sleeve has a bending resistance falling in a range from 20 mm through 150 mm.

4. The sports upper clothing according to claim 2, wherein each vent hole is circular in a plan view, and has a diameter falling in a range from 0.6 mm through 5 mm.

5. The sports upper clothing according to claim 2, wherein the plurality of vent holes have respective diameters that become smaller from the sleeve base line toward the sleeve cap line of each respective sleeve.

6. The sports upper clothing according to claim 2, wherein each vent hole is oval in a plan view, extending in an up-down direction.

7. The sports upper clothing according to claim 1, wherein the front portion of each sleeve is partially or entirely made of a different fabric from the fabric of the back portion.

8. The sports upper clothing according to claim 7, wherein the front portion of each sleeve comprises a mesh fabric.

9. The sports upper clothing according to claim 1, wherein the front body has a highly breathable portion which is configured to be disposed across a region from a collar across shoulders of the wearer and to a breast center of the wearer, when worn, the highly breathable portion and has a third breathability value that is greater than the first breathability value of the back portion of each sleeve.

10. The sports upper clothing according to claim 9, wherein the front portion of each sleeve comprises a fabric and wherein the fabric of the front portion and the fabric of the back portion of each sleeve has a bending resistance falling in a range from 20 mm through 150 mm, and each sleeve is connected to the highly breathable portion.

11. The sports upper clothing according to claim 10, wherein the distal end of the front portion of each sleeve is configured, in a front view, to expose the distal end of the back portion of the sleeve.

12. The sports upper clothing according to claim 11, wherein each sleeve has a rim portion which is disposed at the distal end and has a higher bending resistance than the front portion and the back portion.

13. The sports upper clothing according to claim 12, wherein each sleeve has a sleeve cap line and a sleeve base line, wherein each respective sleeve's sleeve cap line is formed parallel with each respective sleeve's sleeve base line.

14. The sports upper clothing according to claim 11, wherein each sleeve has a sleeve cap line and a sleeve base line, wherein each respective sleeve's sleeve cap line tapers away from each respective sleeve's distal end.

15. The sports upper clothing according to claim 1, further comprising a stretchable portion which is disposed near an armpit region of each sleeve and is more stretchable than surrounding portions of the sports upper clothing.

16. The sports upper clothing according to claim 1, wherein the first breathability value has a maximum of 17 $cm^3/cm^2 \cdot s$.

17. The sports upper clothing according to claim 1, wherein the second breathability value of the front portion and the first breathability value of the back portion have a minimum breathability value difference of 23 $cm^3/cm^2 \cdot s$.

* * * * *